US006789795B2

(12) United States Patent
Kallin et al.

(10) Patent No.: US 6,789,795 B2
(45) Date of Patent: Sep. 14, 2004

(54) VARIABLE PRESSURE DOCUMENT INFEED TRANSPORT APPARATUS FOR USE IN A SELF-SERVICE TERMINAL

(75) Inventors: Fredrik L. N. Kallin, Waterloo (CA); Owen H. Wilson, Kitchener (CA)

(73) Assignee: NCR Corporation, Dayton, OH (US)

( * ) Notice: Subject to any disclaimer, the term of this patent is extended or adjusted under 35 U.S.C. 154(b) by 82 days.

(21) Appl. No.: 10/326,513

(22) Filed: Dec. 19, 2002

(65) Prior Publication Data

US 2004/0118657 A1 Jun. 24, 2004

(51) Int. Cl.[7] ..... B65H 5/00
(52) U.S. Cl. ..... 271/272; 271/902; 194/207
(58) Field of Search ..... 194/207, 302; 271/225, 272, 256, 902; 198/577, 371.1, 371.2, 371.3; 235/379, 380

(56) References Cited

U.S. PATENT DOCUMENTS 5,806,649 A * 9/1998 Walsh et al. ..... 194/203
6,394,446 B1 * 5/2002 Okamoto ..... 271/186

FOREIGN PATENT DOCUMENTS

JP 5-330701 A * 12/1993 ..... B65H/9/06

* cited by examiner

*Primary Examiner*—Donald P. Walsh
*Assistant Examiner*—Mark J. Beauchaine
(74) *Attorney, Agent, or Firm*—Michael Chan

(57) ABSTRACT

A variable pressure document infeed transport provides a first driving pressure on a document being transported in a first direction along a document transport path of a self-service terminal, and provides a second driving pressure which is greater than the first driving pressure on a document being transported in a second direction which is opposite the first direction along the document transport path of the self-service terminal. The first driving pressure means may be provided by a first plurality of idlers centered along the document transport path, and the second driving pressure means may be provided by a second plurality of idlers off-centered along the document transport path.

12 Claims, 8 Drawing Sheets

200
START
210
TRANSPORT CHEQUE
212
PERFORM MICR
214
IMAGE CHEQUE
216
CHEQUE COMPLETED ?
N
Y
218
AMOUNT MATCHES ?
N
Y
220
DISPLAY CHARGE
222
CHARGE ACCEPTED ?
N
Y
224
PRINT ON CHEQUE
226
DISPENSE CASH
240
REVERSE TRANSPORT TO RETURN CHEQUE TO USER
242
CHEQUE RETURNED BY THE USER ?
Y
END
N
244
TRANSPORT CHEQUE TO REJECT BIN
END
227
IMAGE ENDORSED CHEQUE
228
STORE CHEQUE IN STORAGE BIN
END

VARIABLE PRESSURE DOCUMENT INFEED TRANSPORT APPARATUS FOR USE IN A SELF-SERVICE TERMINAL

BACKGROUND OF THE INVENTION

The present invention relates to a self-service terminal, and is particularly directed to a variable pressure document infeed transport apparatus for use in a self-service terminal, such as a cheque cashing ATM.

A cheque cashing ATM allows a registered user, who typically does not have a bank account, to cash a cheque and receive money from the ATM in a public access, unattended environment. A user typically registers with an institution that owns or operates cheque cashing ATMs, and provides identification information (such as a social security number) and information about a cheque (usually a pay cheque) that he/she regularly receives. The registered user is typically provided with a card to initiate a cheque cashing transaction at a cheque cashing ATM. The cheque information typically includes details of how frequently a cheque is paid (for example, every week), who the cheque is paid by (that is, the payor of the cheque), the payor's bank details (for example, a bank code identifying the name of the bank), the typical amount that the cheque is made out for, and such like.

To cash a cheque, a user enters his/her card at a cheque cashing ATM, then enters a cheque to be cashed through a cheque slot in the ATM's fascia. A cheque transport mechanism receives the entered cheque and transports the cheque in a forward direction along a cheque transport path to a number of locations within the ATM to process this cheque. If the cheque is valid, and the details printed on the cheque match the cheque information provided during registration, then the ATM informs the user of a surcharge that will be applied if the user wishes to cash the cheque. If the user agrees to the surcharge, then cash is dispensed to the user and the cheque is transported to and stored in a storage bin within the ATM. If the user does not agree to the surcharge, then the cheque is returned in the reverse direction along the cheque transport path to the user via the cheque slot. The cheque may be returned to the user for other reasons, for example, if the cheque is not complete, if the cheque has not been endorsed by the user, if the ATM decides that the details printed on the cheque do not match the cheque information provided by the user during registration, and such like.

A problem associated with cheque cashing ATMs relates to the condition of the cheques that are presented for cashing. It is difficult for the cheque transport mechanism to transport cheques that have defects such as large tears, holes, creases, folds, dog-ears, and such like, in the reverse direction along the cheque transport path to return such cheques to the user. A substantial percentage of cheques entered at a cheque cashing ATM include one or more of these defects.

One way of handling the above-described problem is to increase the driving pressure of the cheque transport mechanism on the cheque being transported along the cheque transport path. While the increased drive pressure is sufficient to transport a cheque having defects when such cheque is being returned to the user in the reverse direction along the cheque transport path, the increased drive pressure tends to more easily accept a badly crumpled or curled cheque when such cheque is initially entered by the user in the forward direction along the cheque transport path. This may cause a jam condition further downstream along the cheque transport path in the forward direction, resulting in the cheque cashing ATM going out of service until a service call is made.

Moreover, the increased drive pressure is more likely to crumple a skewed cheque. This occurs because some slip in the drive must be provided to allow the skewed cheque to straighten out, and if the drive slip is not provided as a result of providing an increased drive pressure on the skewed cheque, then the skewed cheque will crumple against the sides of the cheque transport path. When the skewed cheque crumples against the sides of the cheque transport path, a jam condition is likely to occur. Also, the increased drive pressure may have a tendency to unpleasantly snatch a cheque out of a user's hand when the cheque is initially entered by the user in the forward direction along the cheque transport path. It would be desirable to provide a cheque transport mechanism which provides a relatively lesser amount of driving pressure on a cheque when the cheque is initially entered and transported in the forward direction along the cheque transport path, and which cheque transport mechanism also provides a relatively greater amount of driving pressure on a cheque having defects when such cheque is transported in the reverse direction along the cheque transport path to return the cheque to the user.

SUMMARY OF THE INVENTION

In accordance with one aspect of the invention, a self-service terminal comprises a fascia including means defining a document slot, and a document processing module including (i) means defining a document transport path, (ii) a document transport mechanism for transporting a document along the document transport path, and (iii) variable pressure infeed transport means for providing a first driving pressure on a document entered via the document slot to transport the document in a forward direction along the document transport path and a second driving pressure which is greater than the first driving pressure on a document to transport the document in a reverse direction along the document transport path to return the document via the document slot.

Preferably, the variable pressure infeed transport means includes a first set of engageable idlers for, when engaged, providing the first driving pressure, and a second set of engageable idlers for, when engaged, providing driving pressure which comprises at least a portion of the second driving pressure. The first set of engageable idlers includes a first plurality of idlers centered along the document transport path, and the second set of engageable idlers includes a second plurality of idlers off-centered along the document transport path. The document processing module includes a MICR reader disposed along the document transport path.

In accordance with another aspect of the invention, an automated teller machine (ATM) comprises an ATM fascia including (i) means defining a currency dispensing slot through which currency can be dispensed to an ATM customer, and (ii) means defining a cheque entrance/exit slot. The ATM further comprises a currency dispenser for dispensing currency via the currency dispensing slot to an ATM customer, and a cheque processing module including (i) means defining a cheque transport path, (ii) means defining a cheque processing zone disposed along the cheque transport path, (iii) a cheque transport mechanism for transporting a cheque along the cheque transport, and (iv) variable pressure infeed transport means for providing a first driving pressure on a cheque entered via the cheque entrancc/exit slot to transport the cheque in a forward direction along the cheque transport path towards the cheque processing zone and a second driving pressure which is greater than the first driving pressure on a cheque to transport the cheque in a reverse direction along the cheque transport path to return the cheque via the cheque entrance/exit slot to an ATM customer.

Preferably, the variable pressure infeed transport means includes a first set of engageable idlers for, when engaged, providing the first driving pressure, and a second set of engageable idlers for, when engaged, providing driving pressure which comprises at least a portion of the second driving pressure. The first set of engageable idlers includes a first plurality of idlers centered along the cheque transport path, and the second set of engageable idlers includes a second plurality of idlers off-centered along the cheque transport path. The cheque processing module includes a MICR reader disposed along the cheque transport path.

In accordance with yet another aspect of the invention, a variable pressure document infeed transport apparatus for use in a self-service terminal comprises means for providing a first driving pressure on a document being transported in a first direction along a document transport path of the self-service terminal, and means for providing a second driving pressure which is greater than the first driving pressure on a document being transported in a second direction which is opposite the first direction along the document transport path of the self-service terminal. The first driving pressure means may include a first plurality of idlers centered along the document transport path, and the second driving pressure means may include a second plurality of idlers off-centered along the document transport path.

In accordance with still another aspect of the invention, a method of processing a financial instrument at a self-service terminal comprises the steps of applying a first driving pressure on the financial instrument when the financial instrument is transported from an entrance/exit slot to a processing zone, and applying a second driving pressure which is greater than the first driving pressure on the financial instrument when the financial instrument is transported from the processing zone to the entrance/exit slot. The financial instrument may comprise a cheque.

BRIEF DESCRIPTION OF THE DRAWINGS

These and other aspects of the present invention will be apparent from the following specific description, given by way of example, with reference to the accompanying drawings, in which.

DETAILS OF THE INVENTION

Figure 1:
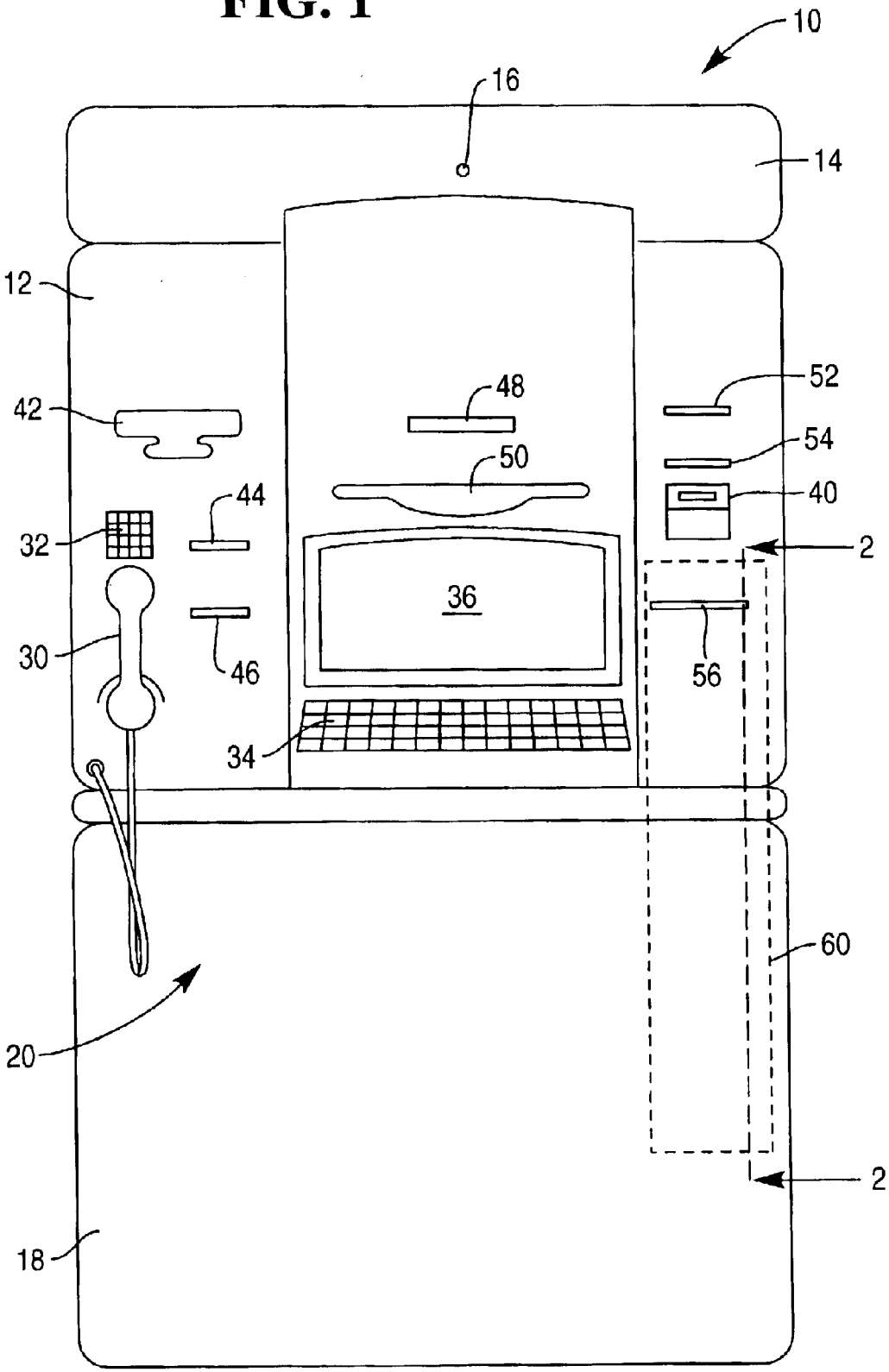
FIG. 1 is a pictorial diagram of a cheque cashing ATM embodying the present invention.

Reference is first made to FIG. 1, which illustrates a self-service terminal 10 in the form of a cheque cashing ATM. The ATM 10 comprises a fascia 12 pivotably coupled to a chassis (not shown); an upper panel 14 mounted to the chassis and defining an aperture 16 through which a camera (not shown) images a user of the ATM 10; and a lower panel 18 hingeably coupled to the chassis (not shown) so that the lower panel 18 can be opened to reveal a safe (not shown) mounted in the chassis (not shown). When the lower panel 18 is open, the fascia 12 can be pivoted upwards to reveal ATM modules mounted within the chassis (not shown).

The fascia 12 and lower panel 18 provide a user interface 20 for allowing a user to execute a transaction. The fascia 12 includes a handset 30 and a telephone keypad 32 for allowing a user to contact a remote operator (not shown) typically located in a call centre (not shown). The fascia 12 also includes an encrypting keyboard 34 for allowing a user to enter transaction details, and a display 36 for presenting screens to a user. The fascia 12 also defines eight slots for receiving and dispensing media items, and a tray 40 into which coins can be dispensed. The slots include: a money order printer slot 42, a bunch note input slot 44, a bunch note exit slot 46, a statement output slot 48, a cash dispense slot 50, a card reader slot 52, a card issue slot 54, and a cheque input/output slot 56. The slots 42 to 56 and tray 40 are arranged so that when the fascia 12 is closed, the slots and tray align with corresponding ATM modules mounted within the ATM's chassis (not shown). The user interface features described above are all provided on an NCR PERSONAS (trade mark) 5878 financial services centre ATM, available from NCR Financial Solutions Group Limited, Discovery Centre, 3 Fulton Road, Dundee, DD2 4SW, Scotland.

Figure 2:
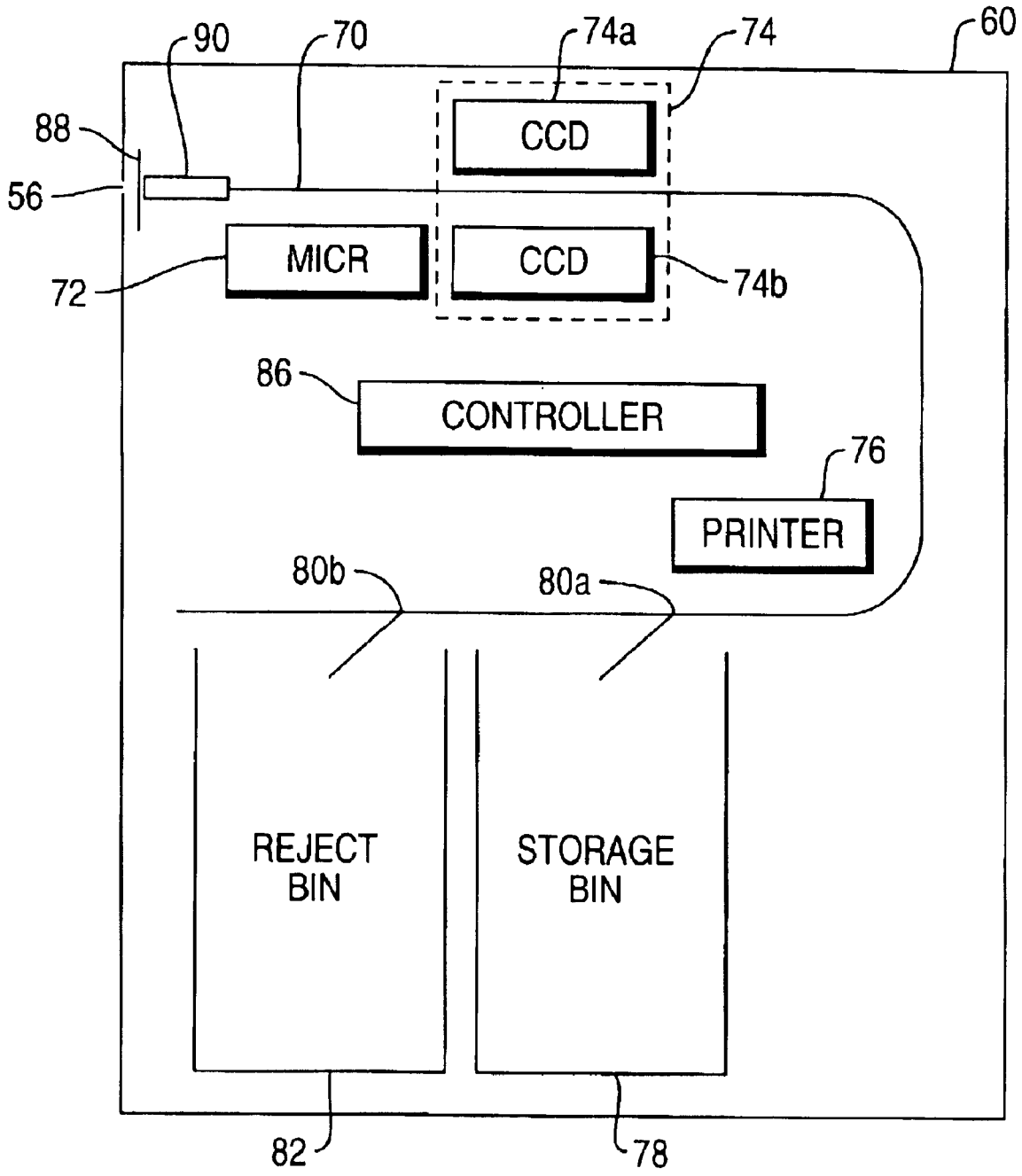
FIG. 2 is a simplified schematic sectional diagram, taken approximately along line 2—2 in FIG. 1, and showing a part (the cheque processing module) of the ATM of FIG. 1.
Figure 3:
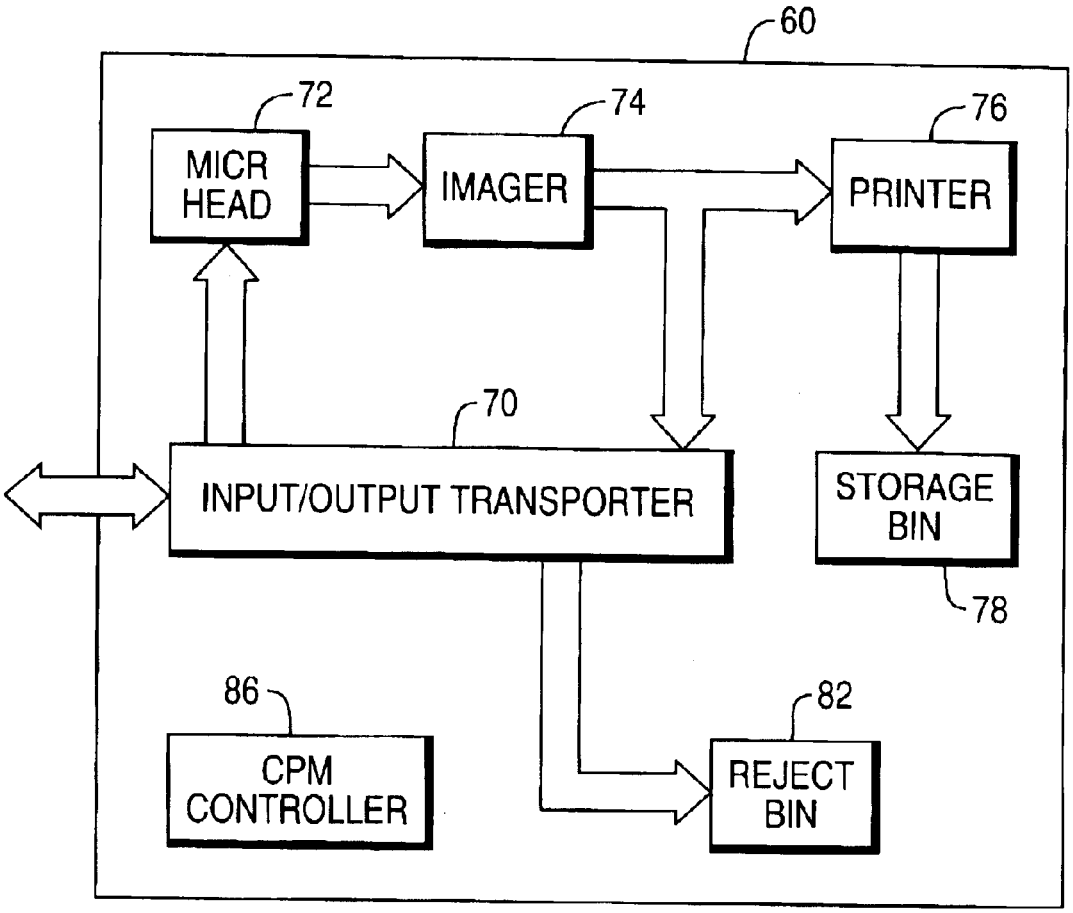
FIG. 3 is a block diagram of the cheque processing module of FIG. 2.

A cheque processing module (CPM) 60 will now be described with reference to FIG. 2 and FIG. 3. FIG. 2 is a simplified schematic sectional diagram (along line 2—2 in FIG. 1) showing part of the fascia 12 and lower panel 18, and the main parts of the CPM 60. FIG. 3 is a block diagram illustrating the main elements in the CPM 60. The CPM 60 is a modified version of a conventional cheque processing module, such as the cheque processing module provided with the PERSONAS (trade mark) 5878 NCR ATM.

The CPM 60 comprises the following elements: a cheque input/output transport mechanism 70 including an alignment mechanism for aligning a cheque; a MICR head 72 for reading magnetic details on a code line of a cheque; an imager 74 including an upper 74*a* and lower 74*b* CCD camera for capturing an image of each side of a cheque (front and rear); a printer 76 for endorsing a cheque; a storage bin 78 for storing processed cheques, and a reject bin 82 for storing rejected cheques. The transport mechanism 70 includes two divert gates 80*a*, 80*b* for diverting cheques to either the storage bin 78 or the reject bin 82. The elements are conventional and will not be described in detail herein. The CPM 60 also includes a controller 86 for controlling the operation of the elements within the CPM 60. The CPM 60 also includes an entrance shutter 88 for opening and closing the cheque input/output slot 56.

Referring to FIGS. 4, 5, 6, and 7, the cheque input/output transport mechanism 70 includes an infeed transport 90 which has a lower part 91 and an upper part 92. The lower part 91 includes a pair of flat belts 93, 94, a smaller flat belt 95, and a drive roller 96 for driving a cheque disposed in a document transport path 98 disposed between the upper and lower parts 91, 92. The transport mechanism 70 further includes a reversible DC motor drive (not shown) which engages a drive gear 102 to drive a main drive shaft 103 through a roll pin 99. The main drive shaft 103, in turn, drives the belts 93, 94, 95 and the drive roller 96. The upper part 92 includes a three center idlers 104, 105, 106, and four off-center idlers 107, 108, 109, 110.

Figure 4:
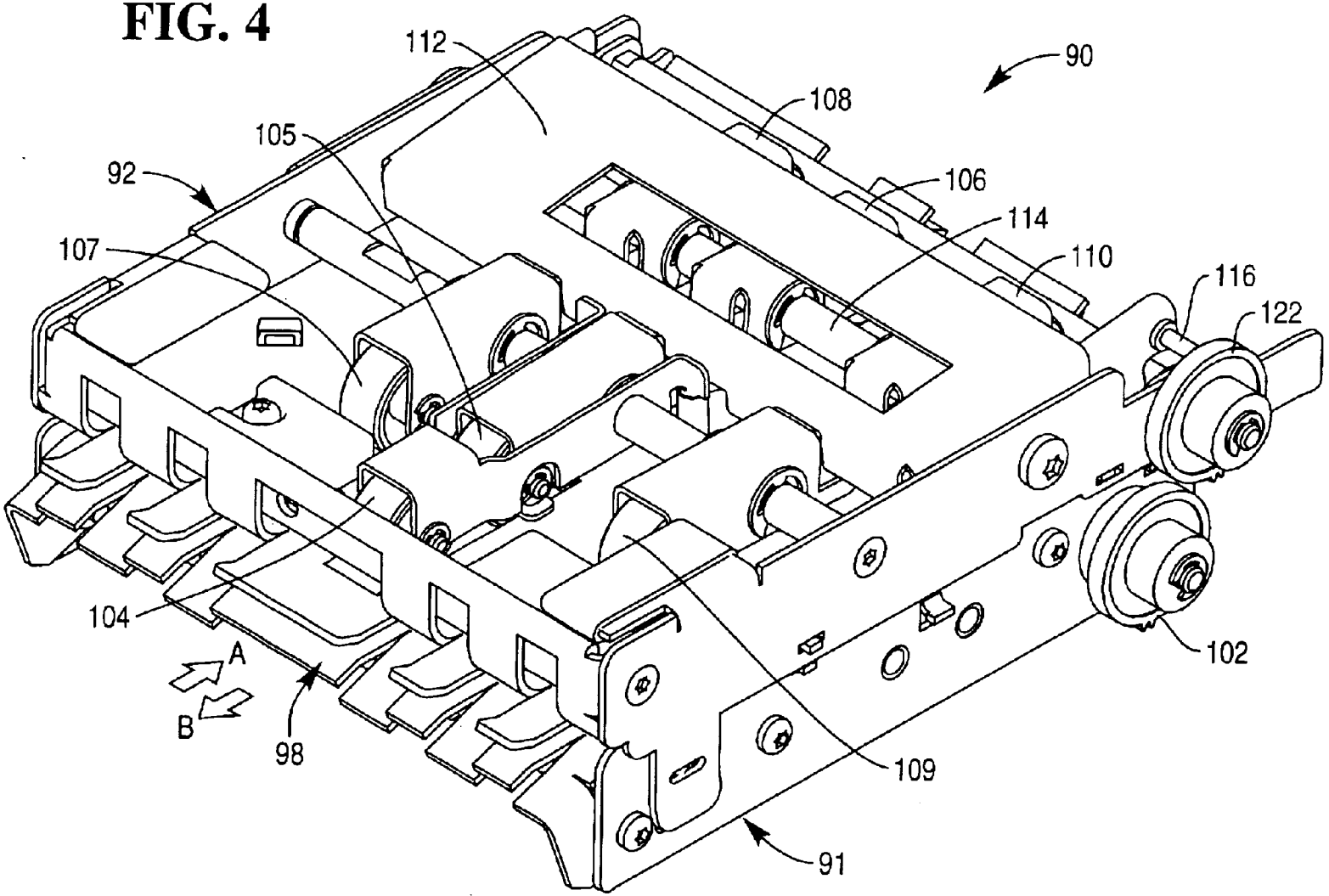
FIG. 4 is a pictorial diagram of a part (the variable pressure infeed transport) of the ATM of FIG. 1.
Figure 7:
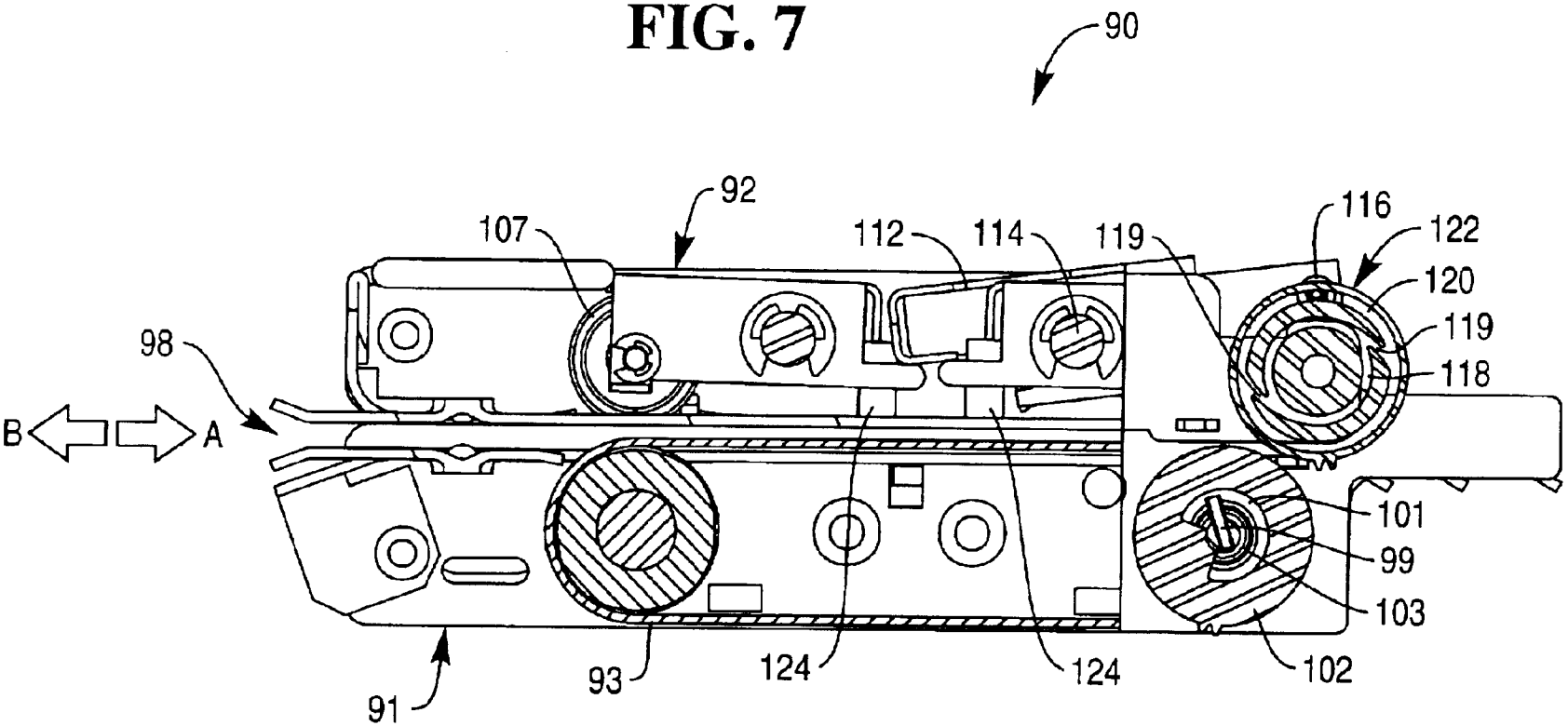
FIG. 7 is a sectional view, taken approximately along line 7—7 of FIG. 6.

The infeed transport 90 includes a lifter bracket 112 which is pivotable on a shaft 114 to move into contact with the off-center idlers 107, 108, 109, 110. When the lifter bracket 112 presses down on the ends of the four off-center idlers 107, 108, 109, 110, as best shown in FIG. 7, the four idlers are disengaged from the flat belts 93, 94. The position of the lifter bracket 112 is controlled by a pin 116 (FIGS. 4 and 7).

The pin 116 travels in either an inner track 118 or an outer track 120 of a cam gear 122 depending upon the direction of rotation of the cam gear. Transition points 119 interconnect the inner and outer tracks 118, 120.

A pair of idler springs 124 (FIG. 7) provides a spring force which always acts on the pin 116 via the lifter bracket 112 to push the pin towards the opposite track on the cam gear 122. When a cheque is initially entered at the slot 56 (FIGS. 1 and 2), the DC motor drive rotates the drive gear 102 and the main drive shaft 103 in the clockwise direction (as viewed looking at FIG. 7) to run the belts 93, 94 in the clockwise direction which, in turn, drives the cheque in the forward direction (as represented by arrow A in FIGS. 4, 6, and 7) along the cheque transport path 98. When the cheque is driven in the forward direction into the cheque transport path 98, the pin 116 rides in the outer track 120 of the cam gear 122 and the spring force of the idler springs 124 push up on the lifter bracket 112 which, in turn, pushes the pin 116 down towards the inner track 118 of the cam gear. Although the spring force of the idler springs 124 pushes the pin 116 towards the inner track 118, the pin stays on the outer track 120 because of the shape of the tracks and the transition points 119 between the tracks.

When the infeed transport 90 is operating in the other direction, the DC motor drive rotates the drive gear 102 and the main drive shaft 103 in the counter-clockwise direction (as viewed looking at FIG. 7) to turn the belts 93, 94 in the counter-clockwise direction which, in turn, drives a cheque in the reverse direction (as represented by arrow B in FIGS. 4, 6, and 7) along the cheque transport path 98. When the infeed transport 90 operates to drive a cheque in the reverse direction along the document transport path 98, the pin 116 will find a transition 119 to the inner track 118. The pin 116 finds a transition 119 in a manner like a stylus running in the grooves of a record.

When the pin 116 reaches the inner track 118, the lifter bracket 112 is no longer in contact with the four off-center idlers 107, 108, 109, 110, and no spring force is being applied to the pin. At this time, a spring 128 (FIG. 6) having a relatively weaker spring force acts on the lifter bracket 112 to push the lifter bracket in the opposite direction which, in turn, pushes the pin 116 towards the outer track 120 of the cam gear 122. The pin 116 now stays on the inner track 118 because of the shape of the tracks 118, 120 and the transitions points 119 between the tracks. Since the lifter bracket 112 is no longer in contact with the four off-center idlers 107, 108, 109, 110, the cheque is driven in the reverse direction along the cheque transport path 98 with all seven idlers 104, 105, 106, 107, 108, 109, 110 engaging the cheque. This engagement provides a relatively greater drive pressure on the cheque in the reverse direction along the cheque transport path 98. The pin 116 remains on the inner track 118 until the direction of drive is again reversed to transport a cheque in the forward direction, at which time the pin will find a transition to the outer track 120.

Figure 5:
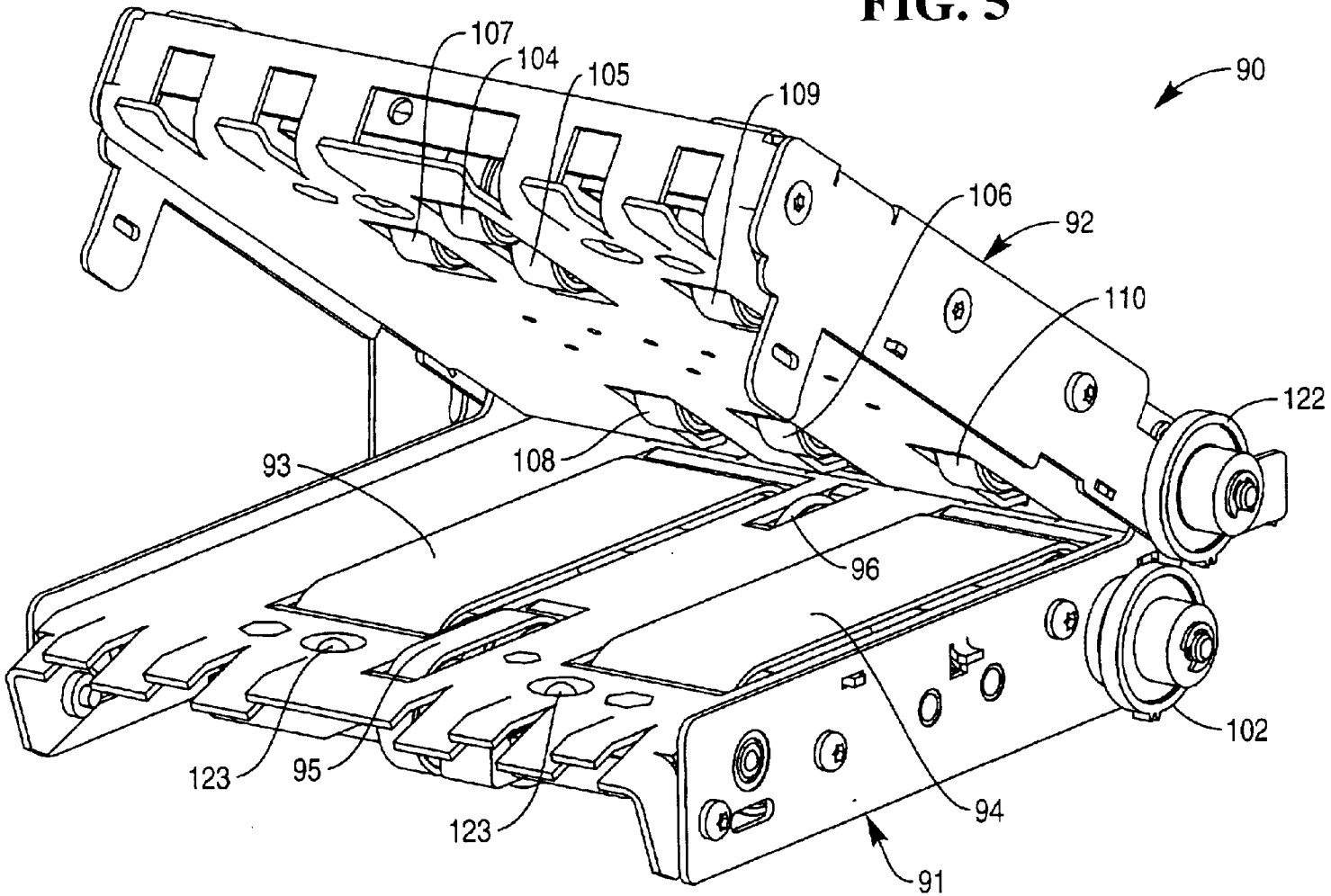
FIG. 5 is a pictorial diagram of the variable pressure infeed transport of FIG. 4 and showing parts in an opened away position.
Figure 6:
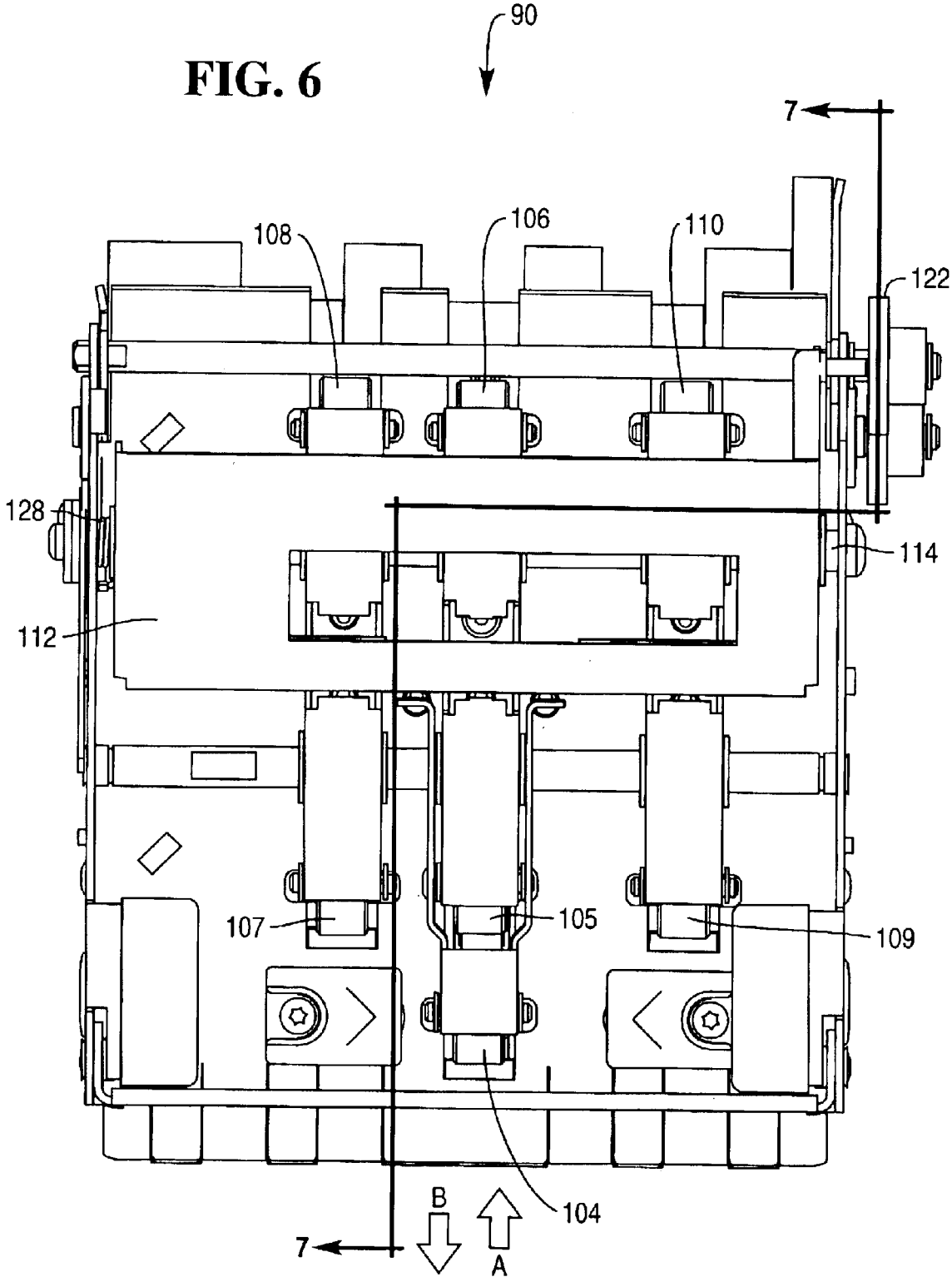
FIG. 6 is a top view of the variable pressure infeed transport of FIG. 4.

The cheque continues to be driven in the reverse direction along the cheque transport path 98 until the leading edge of the cheque is detected by a pair of sensors 123 located along the document transport path, as shown in FIG. 5. When the sensors 123 detect the leading edge of the cheque, the controller 86 commands the DC drive motor to rotate the drive gear 102 in the opposite direction (i.e., in the clockwise direction as viewed looking at FIG. 7).

The drive gear 102 has a cutout 101 with an approximately 270 degrees arcuate shape as shown in FIG. 7 such that the drive gear is able to freewheel a limited distance on the main drive shaft 103 until it (i.e., the drive gear 102) eventually moves into contact with the roll pin 99. While the drive gear 102 is freewheeling the limited distance on the main drive shaft 103, the pressure of the four off-center idlers 107, 108, 109, 110 against the cheque is reduced and the belts 93, 94 remain stationary and do not move.

Since the pressure of the four idlers 107, 108, 109, 110 against the cheque is reduced, the user is able to more easily pull the returned cheque away from the infeed transport 90. Accordingly, the ability of the drive gear 102 to freewheel the limited distance on the main drive shaft 103 provides a dwell feature which allows the user to more easily remove the returned cheque away from the infeed transport 90. The user does not have to withdraw the returned cheque against the much higher pressure that would have been applied against the cheque if the pressure of the four idlers 107, 108, 109, 110 against the cheque had not been reduced.

Figure 8:
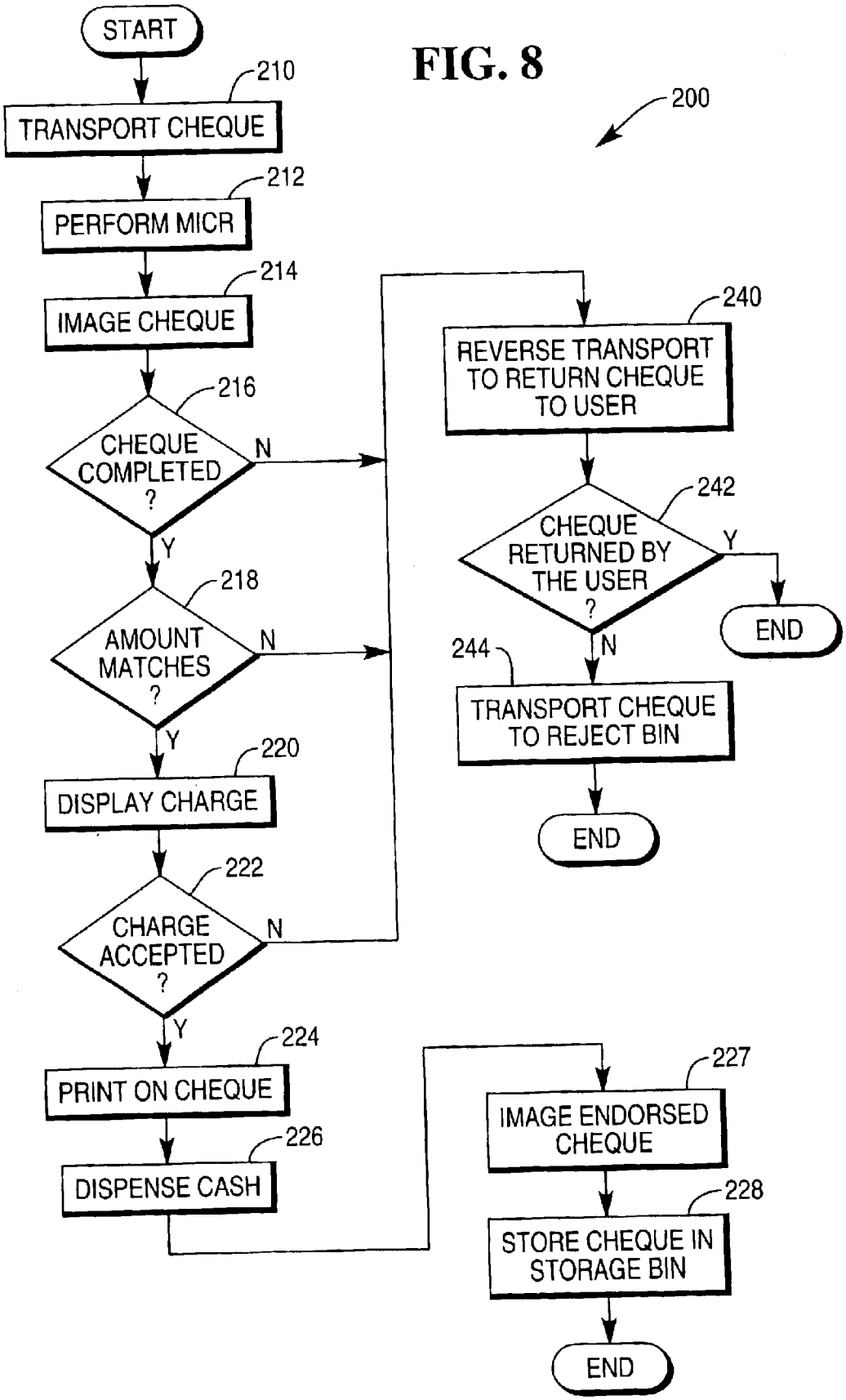
FIG. 8 is a flowchart illustrating the steps involved in a cheque cashing operation.

A typical transaction will now be described with reference to FIG. 8 which is a flowchart 200 illustrating the steps involved in a cheque cashing transaction, and also with reference to FIGS. 1 to 3. In this transaction, a user has registered with an institution owning and operating the ATM 10, and the user has informed the institution that he receives a weekly pay cheque for two hundred dollars, and has received a registration card for accessing cheque cashing functions at the ATM 10. Initially, the user enters the registration card into the card reader slot 52, selects "cheque cashing" from a list of transaction options presented on the display 36, and inserts the cheque to be cashed through the cheque input/output slot 56. The controller 86 opens the slot shutter 88, the infeed transport 90 receives the cheque, and the transport mechanism 70 transports the received cheque (step 210) to the MICR head 72 where a code line on the cheque is read (step 212). The transport mechanism 70 then transports the cheque to the imager 74, where both sides of the cheque are imaged (step 214).

The controller 86 then verifies that the cheque has been completed correctly (step 216). If the cheque is incomplete, then the controller 86 initiates a cheque return operation, described below. If the cheque is complete, then the controller 86 verifies that the amount printed in a courtesy amount field on the cheque matches details provided by the user when the user registered with the institution operating the cheque cashing ATM 10 (step 218). In this example, the user registered a two hundred dollars cheque that was received weekly, and the cheque being presented is made out for two hundred dollars. If the amounts do not match, then the controller 86 initiates a cheque return operation, described hereinbelow. If the amounts do match, as in this example, then the display 36 displays the charge that will be deducted for cashing the cheque (step 220), in this example five dollars, and requests the user to confirm that he is willing to pay this charge to cash the cheque (step 222).

If the user accepts the charge, then the printer 76 prints endorsement data onto the cheque (step 224), and cash is dispensed through the cash dispense slot 50 to the user (step 226). The cash is to the value of the courtesy amount of the cheque minus the charge levied for cashing the cheque, in this example, one hundred and ninety five dollars. The cheque is then transported to the imager 74 to image the endorsed cheque (step 227) before it is transported to the storage bin 78 (step 228) for subsequent collection and further processing. If the user does not wish to pay the charge, then the controller 86 initiates a cheque return operation.

When a cheque return operation is initiated, the transport mechanism 70 reverses the direction of transport (step 240) to convey the cheque to the cheque input/output slot 56 to return the cheque to the user via the cheque input/output slot. The controller 86 may monitor the slot 56 to ensure that the cheque has been removed by the user (step 242). If the user has not removed the cheque within a predetermined time period, the cheque is retracted and conveyed to the reject bin 82 (step 244).

Although the above-description describes a cheque being cashed in its entire amount by an ATM customer, it is contemplated that the cheque may be cashed only in partial amount of the entire amount of the cheque at the ATM 10, with the remaining amount of the cheque being deposited to a banking account. It is also conceivable that the entire amount of the cheque be deposited by an ATM customer into a banking account.

A number of advantages result by providing the infeed transport 90 in accordance with the present invention. One advantage is that a relatively lesser amount of driving pressure on a cheque is provided when the cheque is initially entered and transported in the forward direction, and a relatively greater amount of driving pressure on a cheque is provided when the cheque is transported in the reverse direction to return the cheque to the user. This prevents a user from easily inserting a cheque having defects into the ATM, while allowing such a cheque (especially a cheque having defects) which has been inserted to be more easily returned to the user.

Another advantage is that a cheque being initially inserted is not unpleasantly snatched from the user since the relatively lesser amount of driving pressure is being applied to the cheque when it is being initially inserted. Still another advantage is that a cheque which is skewed when it is initially inserted will have a better tendency to straighten out due to the relatively lesser amount of driving pressure being applied to the cheque when the cheque is initially inserted.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A self-service terminal comprising:

a fascia including means defining a document slot; and a document processing module including (i) means defining a document transport path, (ii) a document transport mechanism for transporting a document along the document sport path, and (iii) variable pressure infeed transport means for providing a first driving pressure on a document entered via the document slot to transport the document in a forward direction along the document transport path and a second driving pressure which is greater than the first driving pressure on a document to transport the document in a reverse direction along the document transport path to return the document via the document slot.

2. A terminal according to claim 1, wherein the variable pressure infeed transport means includes a first set of engageable idlers for, when engaged, providing the first driving pressure, and a second set of engageable idlers for, when engaged, providing driving pressure which comprises at least a portion of the second driving pressure.

3. A terminal according to claim 2, wherein the first set of engageable idlers includes a first plurality of idlers centered along the document transport path, and the second set of engageable idlers includes a second plurality of idlers off-centered along the document transport path.

4. A terminal according to claim 3, wherein the document processing module includes a MICR reader disposed along the document transport path.

5. An automated teller machine (ATM) comprising:

an ATM fascia including (i) means defining a currency dispensing slot through which currency can be dispensed to an ATM customer, and (ii) means defining a cheque entrance/exit slot; and;

a currency dispenser for dispensing currency via the currency dispensing slot to an ATM customer;

a cheque processing module including (i) means defining a cheque transport path, (ii) means defining a cheque processing zone disposed along the cheque transport path, (iii) a cheque transport mechanism for transporting a cheque along the cheque transport, and (iv) variable pressure infeed transport means for providing a first driving pressure on a cheque entered via the cheque entrance/exit slot to transport the cheque in a forward direction along the cheque transport path towards the cheque processing zone and a second driving pressure which is greater than the first driving pressure on a cheque to transport the cheque in a reverse direction along the cheque transport path to return the cheque via the cheque entrance/exit slot to an ATM customer.

6. An ATM according to claim 5, wherein the variable pressure infeed transport means includes a first set of engageable idlers for, when engaged, providing the first driving pressure, and a second set of engageable idlers for, when engaged, providing driving pressure which comprises at least a portion of the second driving pressure.

7. An ATM according to claim 6, wherein the first set of engageable idlers includes a first plurality of idlers centered along the cheque transport path, and the second set of engageable idlers includes a second plurality of idlers off-centered along the cheque transport path.

8. An ATM according to claim 7, wherein the cheque processing module includes a MICR reader disposed along the cheque transport path.

9. A variable pressure document infeed transport apparatus for use in a self-service terminal, the apparatus comprising:

means for providing a first driving pressure on a document being transported in a first direction along a document transport path of the self-service terminal; and means for providing a second driving pressure which is greater than the first driving pressure on a document being transported in a second direction which is opposite the first direction along the document transport path of the self-service terminal.

10. An apparatus according to claim 9, wherein the first driving pressure means includes a first plurality of idlers centered along the document transport path, and the second driving pressure means includes a second plurality of idlers off-centered along the document transport path.

11. A method of processing a financial instrument at a self-service terminal, the method comprising the steps of:

applying a first driving pressure on the financial instrument when the financial instrument is transported from an entrance/exit slot to a processing zone; and applying a second driving pressure which is greater than the first driving pressure on the financial instrument when the financial instrument is transported from the processing zone to the entrance/exit slot.

12. A method according to claim 11, wherein the financial instrument comprises a cheque.

* * * * *

UNITED STATES PATENT AND TRADEMARK OFFICE

CERTIFICATE OF CORRECTION

PATENT NO. : 6,789,795 B2
DATED : September 14, 2004
INVENTOR(S) : Kallin, F. and Wilson, O.

It is certified that error appears in the above-identified patent and that said Letters Patent is hereby corrected as shown below:

Column 7,
Line 43, after "document" delete "sport" and insert -- transport --.

Signed and Sealed this

Tenth Day of May, 2005

JON W. DUDAS
*Director of the United States Patent and Trademark Office*